US009388023B2

(12) United States Patent
Gauthier et al.

(10) Patent No.: US 9,388,023 B2
(45) Date of Patent: Jul. 12, 2016

(54) PARTICULATE-HANDLING BUCKET ASSEMBLY

(71) Applicant: ANVIL ATTACHMENTS, Slaughter, LA (US)

(72) Inventors: John H. Gauthier, Baton Rouge, LA (US); Laura G. Martin, Zachary, LA (US); Jon A. Craft, Denham Springs, LA (US)

(73) Assignee: Anvil Attachments, Slaughter, LA (US)

( * ) Notice: Subject to any disclaimer, the term of this patent is extended or adjusted under 35 U.S.C. 154(b) by 27 days.

(21) Appl. No.: 14/211,859

(22) Filed: Mar. 14, 2014

(65) Prior Publication Data

US 2014/0259814 A1 Sep. 18, 2014

Related U.S. Application Data

(60) Provisional application No. 61/794,795, filed on Mar. 15, 2013.

(51) Int. Cl.

| | |
|---|---|
| ***B66C 3/02*** | (2006.01) |
| ***E02F 3/47*** | (2006.01) |
| ***E02F 3/413*** | (2006.01) |

(52) U.S. Cl.

CPC . *B66C 3/02* (2013.01); *E02F 3/413* (2013.01); *E02F 3/47* (2013.01); *B65D 2251/20* (2013.01); *B65D 2543/00953* (2013.01); *B65D 2590/245* (2013.01)

(58) Field of Classification Search

CPC ..... E02F 3/404; E02F 3/413; E02F 3/3604; E02F 3/4135; E02F 3/4136; E02F 3/4138; E02F 3/47; F16L 21/04; F16L 21/073; F16L 21/05; E02B 7/54; B65D 2590/245; B65D 2543/00953; B65D 2251/20; B65D 88/42; B65D 88/46; B65D 45/02; B66C 3/02

USPC ..... 37/340, 341, 314, 315, 316; 277/402, 277/419, 631; 49/367, 368, 371, 383

See application file for complete search history.

(56) References Cited

U.S. PATENT DOCUMENTS

| | | | | |
|---|---|---|---|---|
| 553,256 | A | 1/1896 | Notter | |
| 1,138,614 | A | 5/1915 | Atkinson | |
| 1,301,626 | A | 4/1919 | Watters | |
| 2,027,409 | A | 5/1932 | Weeks et al. | |
| 2,188,672 | A | 6/1938 | Atkinson | |
| 2,164,988 | A | 10/1938 | De Biasi | |
| 2,177,196 | A * | 10/1939 | Williams | B66C 3/16 37/187 |
| 2,314,395 | A | 10/1941 | Harrington | |

(Continued)

FOREIGN PATENT DOCUMENTS

| | | |
|---|---|---|
| GB | 311582 | 5/1929 |
| WO | 2010136218 A1 | 12/2010 |

*Primary Examiner* — Jamie L McGowan

(74) *Attorney, Agent, or Firm* — Dickinson Wright PLLC

(57) ABSTRACT

The present invention relates to a particulate-handling bucket assembly that provides a sound seal between an extended lip section and an extended cavity section located on opposing scoops of the bucket assembly. The seal is formed by abutting elastomeric material located within a cavity of the extended cavity section against an abutting end of the extended lip section. The elastomeric material has an exposed edge which butts against the abutting end of the extended lip section, with the exposed edge having an exposed height that is greater than or equal to an abutting height of the abutting end of the extended lip section.

20 Claims, 7 Drawing Sheets

(56) References Cited

U.S. PATENT DOCUMENTS 2,284,390 A 11/1941 Harrington
3,286,863 A * 11/1966 Thompson ..... B66C 3/02 37/340
3,410,593 A 11/1968 Goodman, Jr.
3,685,177 A 8/1972 Hahn et al.
3,949,498 A 4/1976 Iwata et al.
4,678,220 A * 7/1987 Gabriel ..... B66C 3/02 294/110.1
5,349,782 A * 9/1994 Yulkowski ..... E05C 19/002 49/366
6,125,591 A * 10/2000 Schmidhuber ..... B60J 10/0037 49/26
7,255,914 B2 8/2007 Shirk et al.
7,360,826 B2 * 4/2008 Nakagawa ..... B60J 10/0022 296/216.06
2004/0177534 A1 9/2004 Jones et al.
2006/0048851 A1 * 3/2006 Wager ..... B66C 3/04 144/4.1
2014/0373400 A1 * 12/2014 Sheehan ..... E02F 9/2883 37/403
2015/0082705 A1 * 3/2015 Kaczmarczyk ..... E06B 7/2309 49/368

* cited by examiner

PARTICULATE-HANDLING BUCKET ASSEMBLY

CROSS-REFERENCE TO RELATED APPLICATIONS

This application claims benefit of the filing date of U.S. Provisional Application No. 61/794,795, filed Mar. 15, 2013, which is incorporated herein by reference.

FIELD OF THE INVENTION

This invention generally relates to a bucket assembly. More particularly, this invention relates to a particulate-handling bucket assembly for sealably containing particulate matter.

BACKGROUND OF THE INVENTION

A bucket assembly is generally considered a specialized container configured for attaching to a machine and for lifting, transporting and/or handling material. The bucket assembly is defined by multiple walls that are movable relative to one another to form an inner volume for holding the material. The bucket assembly can be configured, for example, to attach to a lifting hook of a crane, an arm of an excavating machine, to wires of a dragline excavator, to arms of a power shovel or a tractor equipped with a backhoe loader or to a loader, or to a dredge.

Bucket assemblies can handle numerous types of material. For example, bucket assemblies can be designed to grab and lift small, particulate matter or single, large objects as large as, or larger than, an automobile.

Many challenges arise in designing and building particulate-handling bucket assemblies, i.e., bucket assemblies designed to handle particular matter, whether dry or wet particulate matter. The challenges generally focus around the ability to grab and hold dry or wet particulate matter in the inner volume of the bucket assembly, while minimizing spillage or leakage.

GB 311,582 discloses a bucket assembly or grab for holding particulate matter. The grab includes jaws designed to fit closely together so as to reduce loss of dry powdery material. Inside edges of the jaws are lined with rubber, which projects beyond the edges of the jaws to contact with an opposite meeting edge, also made of rubber. The rubber is attached in the form of strips to the jaws by passing clips or bolts through slots in the rubber slips, and bolting the strips to the jaws. The strips are reinforced with metal to help lengthen the life of the projecting lips of the rubber strips.

U.S. Pat. No. 3,949,498 discloses a grab bucket suitable for dredging sludge. The grab bucket includes a pair of grab shells rotatably hinged by means of hinge pins. Each shell comprises a pair of confronting side walls, each having generally a triangular configuration with a somewhat convex base as well as a rounded apex and a bottom plate connecting the bases of the side walls. The lower sides of the triangular side walls and the lower edge of the bottom plate of each of the grab shells are lined with a seal packing, which is made of an elastic material such as hard rubber. When the lower sides of the triangular side walls and the lower edges of the bottom plates are put tightly together, the elastic material inhibits the material within the closed grab shells from leaking through the contact edges of the side walls and the bottom plates.

There is a continuing need for producing bucket assemblies having the ability to grab and hold dry or wet particulate matter in the inner volume of the bucket assembly, while minimizing spillage or leakage at the edges of the connecting plates of the buckets. There is also a need for reinforced edges on the connecting plates to lengthen the life of the connecting plates.

SUMMARY OF THE INVENTION

This invention provides a bucket assembly having the ability to grab and hold dry or wet particulate matter in the inner volume of the bucket assembly, while minimizing spillage or leakage at the edges of the connecting plates of the buckets. The bucket assembly further includes reinforced edges to lengthen the life of the connecting plates.

According to one aspect of the invention, there is provided a particulate-handling bucket assembly. The assembly comprises a first scoop section and a second scoop section. The first scoop section has a first bottom wall and first side walls. At least one of the first bottom wall and first side walls of the first scoop section includes an extended lip section. Preferably, each of the first bottom wall and first side walls of the first scoop section includes an extended lip section. The extended lip section is comprised of at least one of metal and ceramic and has an abutting end.

The second scoop section has a second bottom wall and second side walls. At least one of the second bottom wall and second side walls of the second scoop section includes an extended cavity section, with the extended cavity section having a cavity with an open end. Preferably, each of the second bottom wall and second side walls of the second scoop section includes an extended cavity section. The extended cavity section is comprised of at least one of metal and ceramic.

Elastomeric material is secured within the cavity of the extended cavity sections of the second scoop section, preferably within each cavity. The secured elastomeric material has an exposed edge, which is configured for abutting against the abutting end of the corresponding extended lip section.

A movement mechanism can be included. The movement mechanism can be configured to abut the exposed edge of the elastomeric material against each of the extended lip sections. This can be accomplished by configuring the movement mechanism to move the first and second scoops into abutting position, such that the exposed edge of the elastomeric material in the cavity of the extended cavity section contacts or abuts the extended lip (i.e., the abutting end of the extended lip).

Excellent contact or sealing can be attained as a result of materials and sizing. For example, excellent contact and/or sealing can be attained due to the exposed edge of the elastomeric material having an exposed height that is greater than or equal to an abutting height of the abutting end of the extended lip section.

According to another aspect of the invention, there is provided a process for transporting particulate matter. According to the process, a particulate-handling bucket assembly is provided. The bucket assembly includes a first scoop section and a second scoop section as described herein. The provided bucket assembly further includes elastomeric material as described herein.

The first and second scoop sections can be moved to open and closed positions. When closed, an internal volume for holding and/or transporting the particulate matter is formed within, or internal to, the bucket assembly. In the closed position, the extended lip section of the first scoop section abuts against or contacts the exposed edge of the elastomeric material to form the inner volume for holding and/or transporting the particulate matter.

The elastomeric material can be secured within the cavity through compressive force. The compressive force can be applied to the elastomeric material by an extending member. The extending member can be configured to extend from an internal surface of the cavity and apply the compressive force to a surface of the elastomeric material.

The materials of the extended lip section and the extended cavity section are complimentary. That is, the materials compliment one another such that overall life of the assembly is extended, and the materials provide a sound seal to hold and/or transport particulate matter.

In one embodiment, the extended lip section and the extended cavity section can be comprised of at least one of metal and ceramic having a melting temperature of at least 200° C.

Alternatively or additionally, the extended lip section and the extended cavity section can be comprised of at least one of metal and ceramic having a density of from 2 $Mg/m^3$ to 18 $Mg/m^3$.

Alternatively or additionally, the extended lip section and the extended cavity section can be comprised of at least one of metal and ceramic having a Young's Modulus of greater than 50 GPa.

Alternatively or additionally, the extended lip section and the extended cavity section can be comprised of at least one of metal and ceramic having a tensile strength of from 150 megapascals to 1500 megapascals.

In one embodiment, the elastomeric material can have a glass transition temperature in the range of from −30° C. to −125° C.

Alternatively or additionally, the elastomeric material can have a density of from 0.5 $Mg/m^3$ to 1.5 $Mg/m^3$.

Alternatively or additionally, the elastomeric material can have a Young's Modulus of less than 1 GPa.

Alternatively or additionally, the elastomeric material can have a tensile strength of less than 80 MPa.

BRIEF DESCRIPTION OF THE DRAWINGS

Other advantages of the invention will be readily appreciated, as the same becomes better understood by reference to the following detailed description when considered in connection with the accompanying drawings wherein.

DETAILED DESCRIPTION OF THE INVENTION

Figure 1:
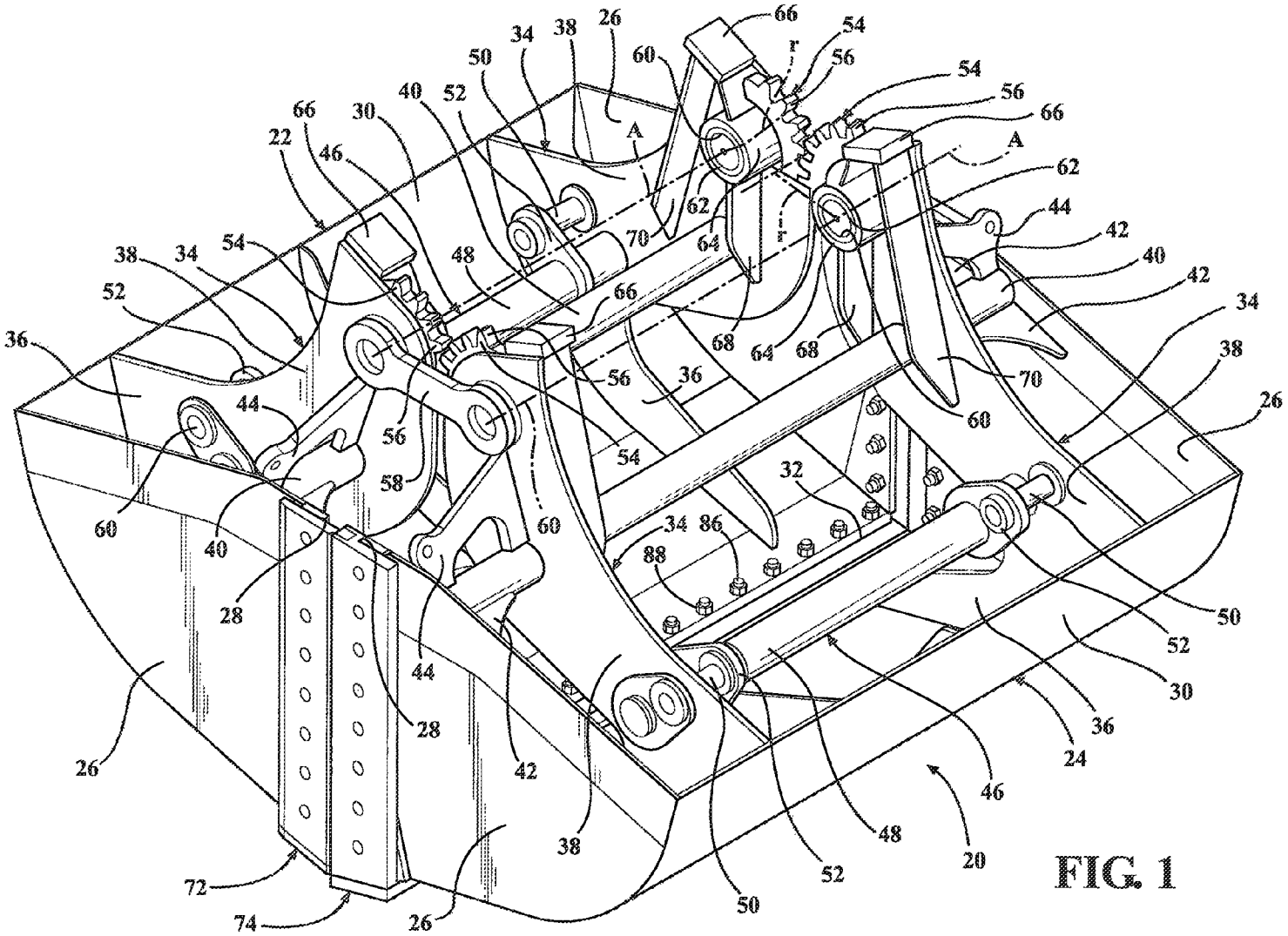
FIG. 1 is a perspective view of the bucket assembly in a closed position.

This invention provides a particulate-handling bucket assembly that provides a sound seal to retain particulate matter within an internal volume of the bucket assembly. The seal is formed by an elastomeric material abutting with or against a metal and/or ceramic surface when scoops of the bucket are in the closed position. The seal configuration allows little if any particulate material to escape the internal volume of the bucket assembly as the material is transported from one location to another. The elastomeric material is also protected from the surrounding environment by the manner in which it is configured in conjunction with the scoops of the bucket.

The bucket assembly can be used to transport a variety of particulate matter. For example, the bucket assembly can be used to transport particulate matter having an average particle size of not greater than 0.25 inches (6.35 mm), or not greater than 0.2 inches (5.08 mm) or not greater than 0.1 inches (2.54 mm). The particulate matter can be wet or dry. For example, the particulate matter can be considered in an aqueous environment, with not greater than 20 wt % or not greater than 10 wt % of the particulate matter being comprised of water, based on total weight of the particulate matter.

The particulate matter can be organic matter, inorganic matter or a combination thereof. Non-limiting examples of the particulate matter include acetate flakes, acrylic material, alumina material, aluminum material, activated carbon material, vegetable matter, seed, anthracite material, antimony material, asbestos material, ash, barium material, borax material, calcium material, cement material, charcoal and graphite material, clays, coffee, corn, ferrous and ferric material, glass material, lime and limestone material, nuts, nylon, plastic material, rubber material, salts, sulfur and sulfurous material, tobacco and zinc material.

The particulate matter can have a wide variety of densities. For example, the particulate material can have an average density of from 5 pounds per cubic foot (80.1 $kg/m^3$) to 200 pounds per cubic foot (3024 $kg/m^3$).

An example of how scoops of the bucket form the seal is shown in FIGS. 6A-B and 7A-B. The particulate-handling bucket assembly can be comprised of a first scoop section 22. The first scoop section 22 includes a first bottom wall 30*a* and first side walls 26*a*. The first bottom wall 30*a* and first side walls 30*a* of the first scoop section 22 each includes an extended lip section 72, which can be removably attached to the bottom wall and/or sides. The extended lip section 72 can be comprised of at least one of metal and ceramic and has an abutting end 77, which has a height h.

A second scoop section 24 has a second bottom wall 30*b* and second side walls 26*b*. The second bottom wall 30*b* and second side walls 26*b* of the second scoop section 24 each include an extended cavity section 74. The extended cavity section 74 has a cavity 92 with an open end. The extended cavity section can be comprised of at least one of metal and ceramic.

Elastomeric material 90 is secured within the cavity 92 of each of the extended cavity sections 74. The secured elastomeric material has an exposed edge 100 for abutting against the abutting end 77 of each of the extended lip sections 72.

A movement mechanism (refer to FIGS. 1-3) is configured to move the first scoop section 22 and second scoop section 24. For example, the first scoop section 22 and second scoop section 24 are configured to move so that the exposed edge of the elastomeric material 90 abuts against each of the extended lip sections 72 at the abutting ends 77. Preferably, the exposed edge 100 of the elastomeric material 90 has an exposed height H that is greater than or equal to the height h of the abutting end 77 of the extended lip sections 72. The relative ratio of the height H to the height h is preferably greater than 1:1. For example, relative ratio of the height H to the height h can range from >1:1 to 20:1 or >1:1 to 10:1 or >1:1 to 5:1.

The elastomeric material 90 can be secured within the cavity through compressive force applied to the elastomeric material by an extending member 94. The extending member 94 extends from an internal surface 102 of the cavity and applies the compressive force to a surface 104 of the elastomeric material 90.

The extended lip section and the extended cavity section can be made of a material comprised of at least one of metal and ceramic. The metal and/or ceramic have characteristics that are suitable for a relatively long lifetime of contacting particulate matter and sealing against the elastomeric material.

In one embodiment, the extended lip section and extended cavity section can be made of material having a melting temperature of at least 200° C. Alternatively, the extended lip section and extended cavity section can be made of material having a melting temperature of at least 400° C., or at least 600° C., at least 800° C.

In one embodiment, the extended lip section and the extended cavity section can be comprised of at least one of metal and ceramic having a density of from 2 $Mg/m^3$ to 18 $Mg/m^3$. Alternatively, the extended lip section and the extended cavity section can be comprised of at least one of metal and ceramic having a density of from 4 $Mg/m^3$ to 12 $Mg/m^3$.

In one embodiment, the extended lip section and the extended cavity section can be comprised of at least one of metal and ceramic having a Young's Modulus of greater than 50 GPa. For example, the extended lip section and the extended cavity section can be comprised of at least one of metal and ceramic having a Young's Modulus of from 60 GPa to 750 GPa, or from 100 GPa to 500 GPa.

In one embodiment, the extended lip section and the extended cavity section can be comprised of at least one of metal and ceramic having a tensile strength of at least 100 megapascals. For example, the extended lip section and the extended cavity section can be comprised of at least one of metal and ceramic having a tensile strength of from 150 megapascals to 1500 megapascals or from 200 megapascals to 1000 megapascals.

The metals can be ferric or non-ferric. Non-limiting examples of ferric metals include cast irons, high carbon steels, medium carbon steels, low carbon steels, low alloy steels and stainless steels. Non-limiting examples of non-ferric metals include aluminum alloys, copper alloys, lead alloys, magnesium alloys, nickel alloys, titanium alloys and zinc alloys.

The ceramics are preferably non-porous. Non-limiting examples of non-porous ceramics include alumina, aluminum nitride, boron carbide, silicon, silicon carbide, silicon nitride and tungsten carbide.

The terms "elastomer" or "elastomeric material" are used synonymously and refer to a material that possesses rubber-like properties. For example, an elastomeric material will substantially recover its original dimensions after compression and/or elongation. Non-limiting examples of suitable elastomers include butadiene rubber, styrene-butadiene rubber, butyl rubber, ethylene-propylene rubber, ethylene-propylene-diene rubber, ethylene vinyl acetate rubber, isoprene rubber, natural rubber, polyisoprene rubber, polychloroprene rubber (including neoprene), polyurethanes, silicon rubber, nitrile rubber and blends thereof.

In one embodiment, the elastomeric material can have a glass transition temperature in the range of from −30° C. to −125° C. Alternatively, the elastomeric material can have a glass transition temperature in the range of from −35° C. to −90° C. or from −40° C. to −60° C.

In one embodiment, the elastomeric material can have a density of less than 2 $Mg/m^3$. For example, the elastomeric material can have a density of from 0.5 $Mg/m^3$ to 1.5 $Mg/m^3$, or from 0.8 $Mg/m^3$ to 1.3 $Mg/m^3$.

In one embodiment, the elastomeric material can have a Young's Modulus of less than 1 GPa. For example, the elastomeric material can have a Young's Modulus of from 0.00001 GPa to 0.1 GPa, or from 0.0005 GPa to 0.05 GPa.

In one embodiment, the elastomeric material can have a tensile strength of less than 80 MPa. For example, the elastomeric material can have a tensile strength of from 1 MPa to 50 MPa, or from 5 MPa to 40 MPa.

Figure 2:
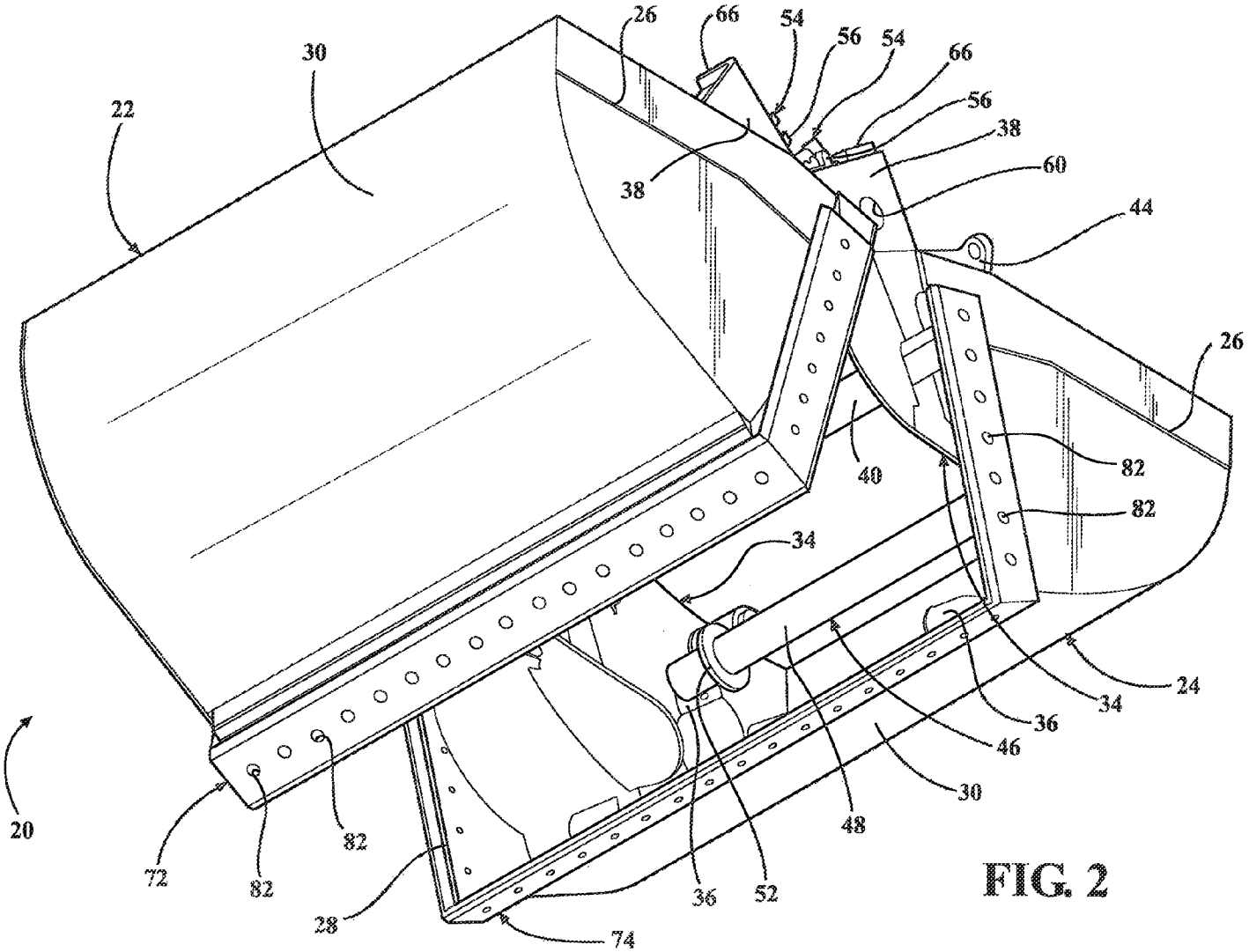
FIG. 2 is a perspective view of the bucket assembly in an open position.

Examples of various embodiments of the bucket assembly of this invention are shown in each of the Figures. As shown in the embodiment of FIGS. 1-2, the assembly includes a plurality of scoops 20. The scoops 20 include a first scoop section 22 and a second scoop section 24, which are configured so that the edges of each section can abut one another. In one embodiment, the scoop sections can abut one another to form a U-shape in cross-section. Each of the scoops 20 includes a pair of side walls 26 each having a front edge 28 and a top edge diverging from one another and a back edge extending between the front edge 28 and the top edge. A bottom wall 30 connects the back edges of the side walls 26 and presents a bottom edge 32 extending along the bottom wall 30 between the front edge 28 and side walls 26 for disposition adjacent one another in the closed position. Each of the scoops 20 defines a plurality of mounting apertures spaced apart from one another along the front edge 28 and the bottom edge 32 in a linear relationship.

A pair of hinge frames 34, as generally indicated, is spaced from one another in parallel relationship and secured to the bottom wall 30 and disposed spaced apart from the side walls 26. The hinge frames 34 of the first scoop section 22 are aligned and paired with the hinge frames 34 of the second scoop section 24 to define a paired first and second hinge frames 34. In other words, the hinge frames 34 of the first scoop section 22 and the hinge frames 34 of the second scoop section 24 are directly aligned with one another in the same plane. Each of the hinge frames 34 includes a leg portion 36 secured to and extending along the bottom wall 30 perpendicular to the bottom edge 32 along the bottom wall 30. A top portion 38 defining a center surface and an outer surface extends upwardly from the leg portion 36 above the side walls 26.

The first scoop section 22 and the second scoop section 24 each includes a wall connector 40 extending between distal ends at the side walls 26 and through the top portion 38 o the hinge frames 34 for connecting the hinge frames 34 and the side walls 26 to one another. A pair of gussets 42 extends radially outwardly from each of the distal ends and secured to the side wall 26. A lift bracket 44 is disposed between the side walls 26 and the outer surface of each of the hinge frames 34 and extending radially and secured to the wall connector 40 and perpendicularly and secured to the hinge frames 34 for raising and lowering the scoops 20. In other words, each lift bracket 44 is attached to a lifting mechanism which is used to raise and lower the scoops 20.

An actuator bar 46, as generally indicated, extends between the hinge frames 34 for rotating the scoops 20 in response to an actuation mechanism between a closed position with the bottom edges 32 adjacent to one another and an open position with the bottom edges 32 spread apart and being defined by a frame connector 48 extending between the center surfaces of the hinge frames 34 for connecting the hinge frames 34 with one another. The actuator bar 46 includes a rod 50 disposed in each of the connection apertures extending parallel to the frame connector 48 and perpendicularly from the top portion 38 of the center surfaces of the hinge frames 34. A link 52 is disposed about the frame connector 48 adjacent to each of the center surfaces of the hinge frames 34 and secured to the rod 50 adjacent thereto. The actuation mechanism can be secured to the frame connector 48 or the rod 50 between the link 52 and the hinge frames 34. Alternatively, the actuator mechanism can be attached directly to the frame connector 48. Each of the hinge frames 34 defines a connection aperture disposed adjacent to the top portion 38 and disposed radially from the frame connector 48 of the actuator bar 46. Further, instead of having a lifting mechanism and an actuation mechanism, the actuation mechanism can include the lifting mechanism attached thereto. The lifting mechanism can work either independently or in conjunction with the actuation mechanism for both raising and lowering of the scoops 20 and rotating the scoops 20 between the open position and the closed position.

A gear segment 54, as generally indicated, is disposed on the outer surface of each of the hinge frames 34 and presents a plurality of teeth 56 extending radially outwardly from and o a tooth radius r disposed above the top portion 38 and about a center axis A with the teeth 56 of the gear segments 54 of the paired first and second hinge frames 34 in a meshing engagement. A bridging piece 58 is disposed on the center surfaces of each of the first and second paired hinge frames 34 for rotatably connecting the center axis A of the first and second paired hinge frames 34 of the scoops 20 with one another to maintain the gear segments 54 of the first and second paired hinged frames of the scoops 20 in the meshing engagement connection with one another. The top portion 38 of each of the hinge frames 34 defines a bore 60 disposed about on the center axis A extending between the center surface and the outer surface. Each of the bridging pieces 58 includes a pair of coupling shafts 62 disposed through one of the bores 60 for allowing the hinge frames 34 to rotate about the coupling shafts 62 between the open position and the closed position. In other words, the coupling shafts 62 are disposed through the bores 60 of the hinge frames 34 allowing the bridging piece 58 to rotatably interconnect the hinge frames 34 with one another. In other words, the bridging piece 58 holds the teeth 56 of the gear segments 54 in a constant mesh engagement with one another when the hinge frames 34 are rotated about the center axis A between the open position and the closed position.

A collar 64 is disposed on the center surface of each of the hinge frames 34 concentric to the center axis A and extending outwardly and perpendicularly from the center surface. Each of the coupling shafts 62 of the bridging pieces 58 is disposed in one of the collars 64. A stopping block 66 is disposed on the top portion 38 adjacent to the teeth 56 of each of the gear segments 54 for engaging stopping blocks 66 of the paired first and second hinge frames 34 for limiting relative rotational movement between the gear segments 54 to define the open position of the scoops 20. Each of the stopping blocks 66 includes a first rib 68 disposed on the center surface of the hinge frame 34 and extending downwardly from the stopping block 66 and attaching to the collar 64. A second rib 70 is disposed on the center surface extending downwardly from each of the stopping blocks 66 for providing support to each of the stopping blocks 66.

Figure 3:
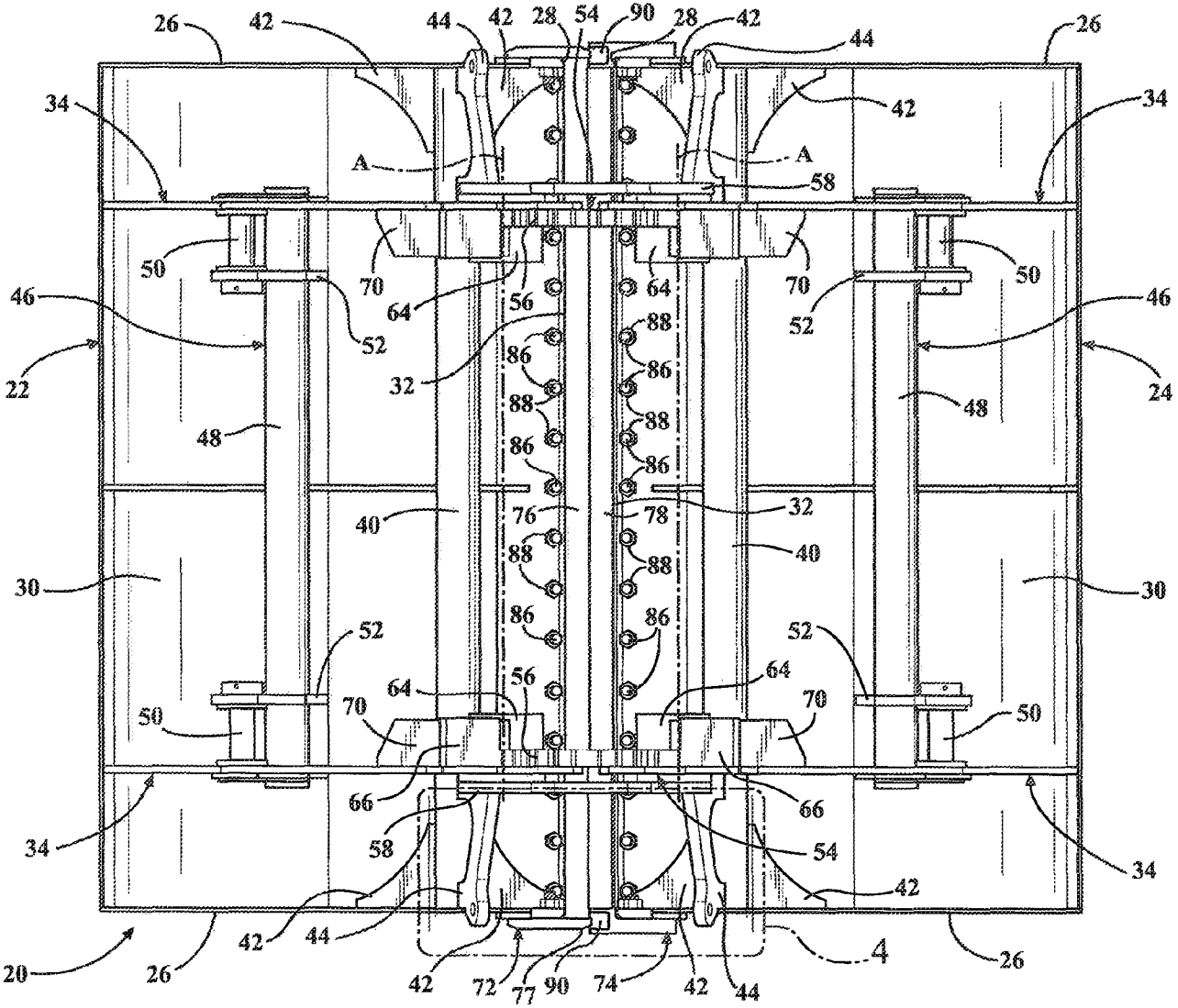
FIG. 3 is a top view of the bucket assembly.
Figure 4:
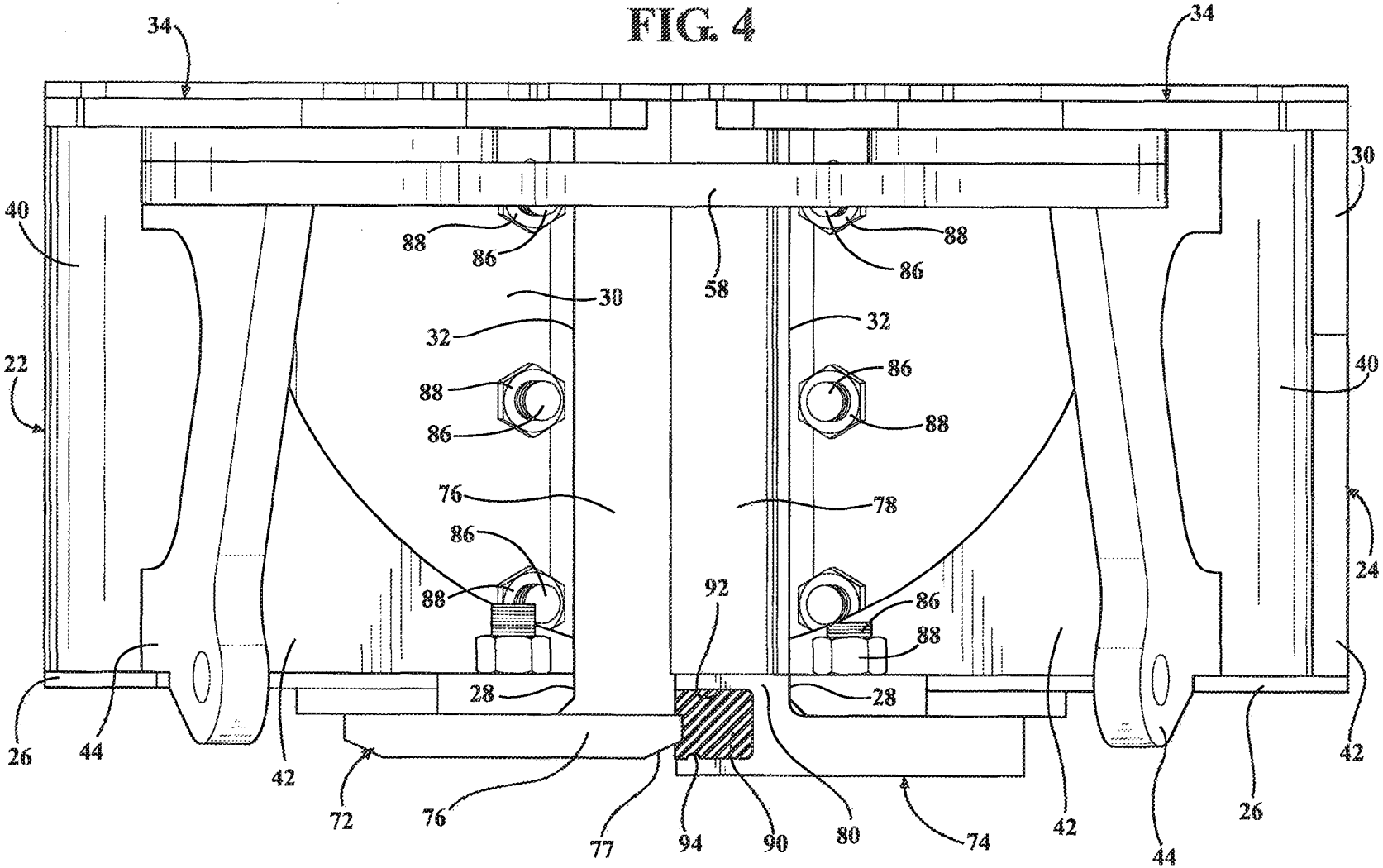
FIG. 4 is an enlarged fragmentary top view of the bucket assembly in the closed position taken with the rectangle labeled 4 in FIG. 3 and the sealing strip is shown in cross-section.
Figure 5:
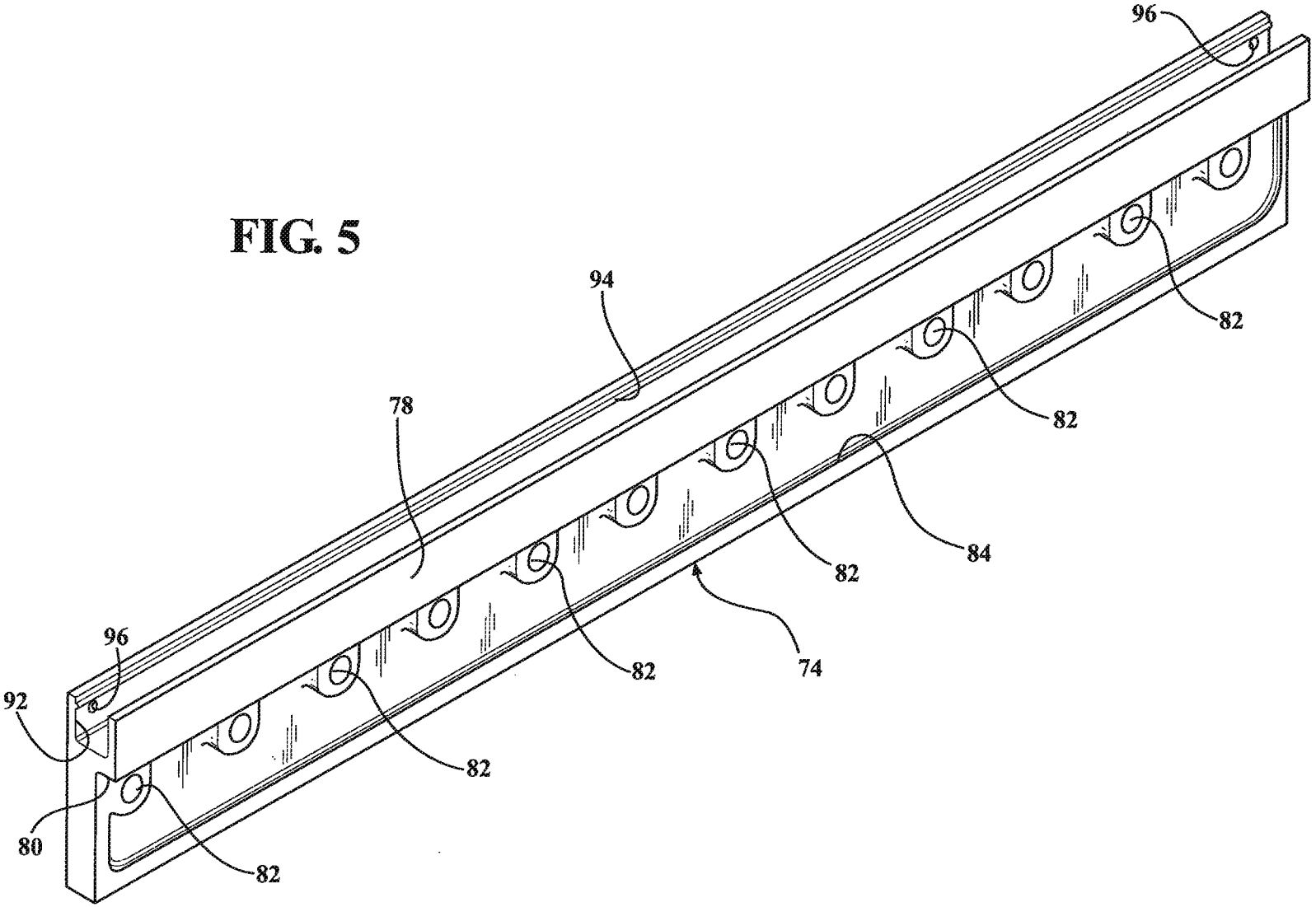
FIG. 5 is a perspective view of the extended cavity section of the bucket assembly.
Figure 6A:
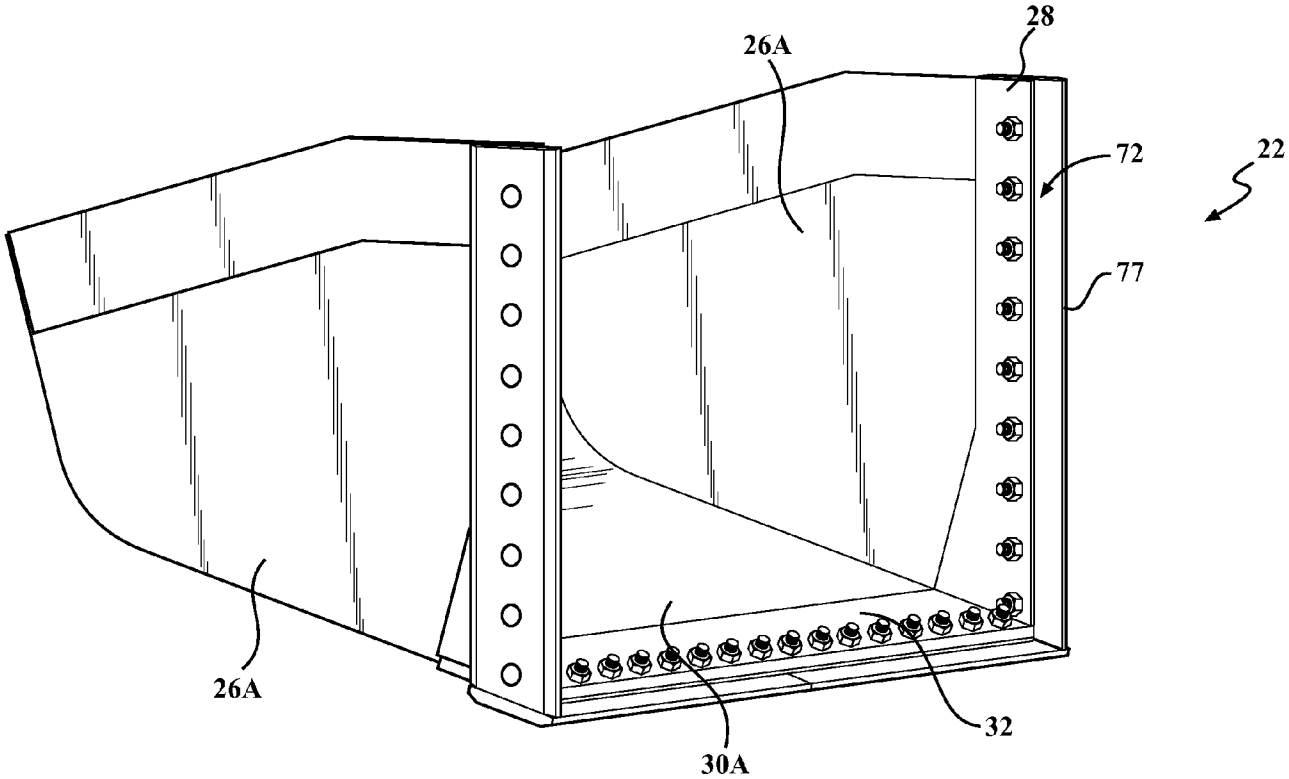
FIGS. 6A and 6B are a perspective view and exploded view, respectively, of a lip section attached to a scoop section of the bucket assembly.
Figure 6B:
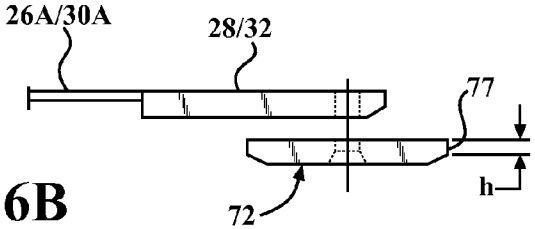
Figure 7A:
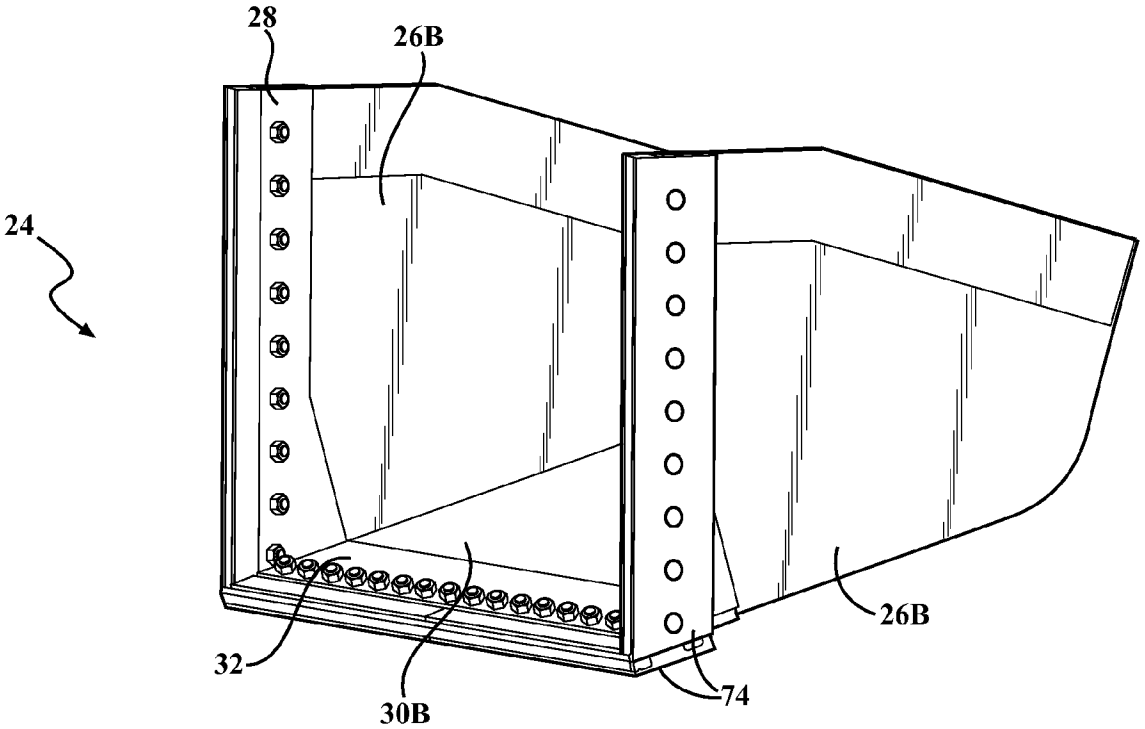
FIGS. 7A and 7B are a perspective view and exploded view, respectively, of an extended cavity section attached to a scoop section of the bucket assembly.
Figure 7B:
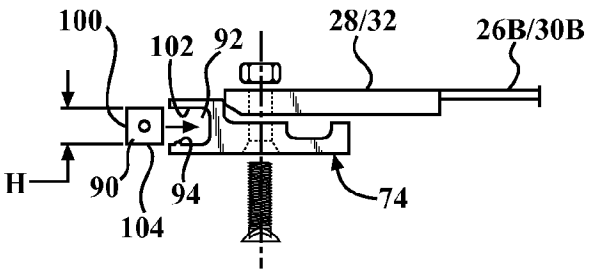

At least one extended lip section 72, as generally indicated in FIGS. 3-5, is made of substantially rigid material, e.g. metal and/or ceramic, and is disposed on the front edge 28 and the bottom edge 32 of the first scoop section 22. At least one extended cavity section 74, as generally indicated, also made of substantially rigid material, e.g. metal and/or ceramic, disposed on the front edge 28 and the bottom edge 32 of the second scoop section 24. The extended lip section 72 defines an abutting portion 76 having a abutting end 77 and the extended cavity section 74 defines a receiving portion 78 extending beyond the front edge 28 and the bottom edge 32 of the scoops 20. The extended cavity section 74 includes a recess having a L-shape defining a shoulder 80 for receiving and engaging the edges 28, 32 of the bottom wall 30 and the side walls 26 of the second scoop section 24. In an alternative embodiment, instead of having both the extended lip section 72 and the extended cavity section 74 extending beyond the bottom edge 32 of the scoop 20, either one of the extended lip section 72 or the extended cavity section 74 can extend beyond the bottom edge 32 of the scoop 20 to engage one another.

The extended lip section 72 and extended cavity section 74 define a plurality of attachment apertures 82 disposed spaced apart from one another in a linear relationship and concentric to the mounting apertures of the scoops 20. The extended cavity section 74 defines a concavity 84 disposed below and between the attachment apertures 82. A plurality of bolts 86 are disposed in the attachment apertures 82 extending through the mounting apertures connecting the extended lip section 72 and extended cavity section 74 to the scoops 20. A plurality of nuts 88 are disposed on the center surface of the bottom wall 30 and the side walls 26 and threadedly engage the bolts 86 for securing the extended lip section 72 and extended cavity section 74 to the scoops 20. Alternatively, instead of a nut-bolt engagement, the extended lip section 72 and extended cavity section 74 can be attached to the bottom of the scoops 20 via other methods of attachment, e.g. welding.

A sealing strip 90 of the elastomeric material is attached to the receiving portion 78 of the extended cavity section 74 for engaging and sealing elastomeric material within the extended cavity section 74 with the abutting end 77 of the abutting portion 76 of the extended lip section 72 in the closed position. The extended cavity section 74 includes a cavity 92 extending along the extended cavity section 74, and the sealing strip 90 is disposed completely within the cavity 92 thereby allowing the extended lip section 72 to engage the sealing strip 90, when in the closed position. In an embodiment of the invention, the sealing strip 90 does not extend substantially beyond the cavity 92 of the extended cavity section 74, for example, does not extend beyond 0.5 cm, or 0.3 cm, or 0.1 cm of the cavity 92, i.e., the open end of the cavity 92. Because the sides of the U-shaped cavity 92 are co-extensive with the sealing strip 90, the sealing strip 90 is protected from lateral movement and self-supporting wear as the rigid extended cavity section 74 protects the sealing strip 90. A extending member 94 extends into the cavity 92 of the extended cavity section 74 for engaging and retaining the sealing strip 90 in the cavity to allow the extended cavity section to protect said sealing strip. The extended cavity section 74 can include at least one retainer aperture 96 that extends into the cavity 92 for receiving at least one fastener extending through the retainer apertures 96 and the sealing strip 90 to retain the sealing strip 90 in the cavity 92. The at least one fastener does not apply sufficient compressive force to retain the sealing strip 90 in lieu of the extended member 94. Rather, the extended member 94 applies compressive force sufficient to retain the sealing strip 90 within the cavity 92 without having to use any fasteners.

The principles and modes of operation of this invention have been described above with reference to various exemplary and preferred embodiments. As understood by those of skill in the art, this invention also encompasses a variety of preferred embodiments within the overall description of the invention as defined by the claims, which embodiments have not necessarily been specifically enumerated herein.

The invention claimed is:

1. A particulate-handling bucket assembly, comprising a first scoop section, with the first scoop section having a first bottom wall and first side walls, with at least one of the first bottom wall and first side walls of the first scoop section including an extended lip section, the extended lip section being comprised of at least one of metal and ceramic and having an abutting end;

a second scoop section, with the second scoop section having a second bottom wall and second side walls, with at least one of the second bottom wall and second side walls of the second scoop section including an extended cavity section having a cavity with an open end, the extended cavity section comprised of at least one of metal and ceramic;

elastomeric material secured within the cavity of the extended cavity section, with the secured elastomeric material having an exposed edge for abutting against the abutting end of the extended lip section; and a movement mechanism configured to abut the exposed edge of the elastomeric material against the abutting end of the extended lip section, wherein the exposed edge of the elastomeric material has an exposed height that is greater than or equal to an abutting height of the abutting end of the extended lip sections.

2. The particulate-handling bucket assembly of claim 1, wherein the elastomeric material is secured within the cavity through compressive force applied to the elastomeric material by an extending member, which extends from an internal surface of the cavity and applies the compressive force to a surface of the elastomeric material.

3. The particulate-handling bucket assembly of claim 1, wherein the extended lip section and the extended cavity section are comprised of at least one of metal and ceramic having a melting temperature of at least 200° C.

4. The particulate-handling bucket assembly of claim 3, wherein the extended lip section and the extended cavity section are comprised of at least one of metal and ceramic having a density of from 2 $Mg/m^3$ to 18 $Mg/m^3$.

5. The particulate-handling bucket assembly of claim 4, wherein the extended lip section and the extended cavity section are comprised of at least one of metal and ceramic having a Young's Modulus of greater than 50 GPa.

6. The particulate-handling bucket assembly of claim 5, wherein the extended lip section and the extended cavity section are comprised of at least one of metal and ceramic having a tensile strength of from 150 megapascals to 1500 megapascals.

7. The particulate-handling bucket assembly of claim 1, wherein the elastomeric material has a glass transition temperature in the range of from −30° C. to −125° C.

8. The particulate-handling bucket assembly of claim 7, wherein the elastomeric material has a density of from 0.5 $Mg/m^3$ to 1.5 $Mg/m^3$.

9. The particulate-handling bucket assembly of claim 1, wherein the elastomeric material has a Young's Modulus of less than 1 GPa.

10. The particulate-handling bucket assembly of claim 9, wherein the elastomeric material has a tensile strength of less than 80 MPa.

11. A process for transporting particulate matter, comprising a) providing a particulate-handling bucket assembly, wherein the bucket handling assembly is comprised of, a first scoop section, with the first scoop section having a first bottom wall and first side walls, with at least one of the first bottom wall and first side walls of the first scoop section including an extended lip section, the extended lip section being comprised of at least one of metal and ceramic and having an abutting end, a second scoop section, with the second scoop section having a second bottom wall and second side walls, with at least one of the second bottom wall and second side walls of the second scoop section including an extended cavity section having a cavity with an open end, the extended cavity section comprised of at least one of metal and ceramic, and elastomeric material secured within the cavity of each of the extended cavity sections, with the secured elastomeric material having an exposed edge for abutting against the abutting end of each of the extended lip sections, elastomeric material secured within the cavity of the extended cavity section, with the secured elastomeric material having an exposed edge for abutting against the abutting end of the extended lip section; and b) abutting the extended lip section of the first scoop section against the exposed edge of the elastomeric material to form an inner volume for transporting the particulate matter.

12. The process of claim 11, wherein the elastomeric material is secured within the cavity through compressive force applied to the elastomeric material by an extending member, which extends from an internal surface of the cavity and applies the compressive force to a surface of the elastomeric material.

13. The process of claim 11, wherein the extended lip section and the extended cavity section are comprised of at least one of metal and ceramic having a melting temperature of at least 200° C.

14. The process of claim 13, wherein the extended lip section and the extended cavity section are comprised of at least one of metal and ceramic having a density of from 2 $Mg/m^3$ to 18 $Mg/m^3$.

15. The process of claim 14, wherein the extended lip section and the extended cavity section are comprised of at least one of metal and ceramic having a Young's Modulus of greater than 50 GPa.

16. The process of claim 15, wherein the extended lip section and the extended cavity section are comprised of at least one of metal and ceramic having a tensile strength of from 150 megapascals to 1500 megapascals.

17. The process of claim 11, wherein the elastomeric material has a glass transition temperature in the range of from −30° C. to −125° C.

18. The process of claim 17, wherein the elastomeric material has a density of from 0.5 $Mg/m^3$ to 1.5 $Mg/m^3$.

19. The process of claim 11, wherein the elastomeric material has a Young's Modulus of less than 1 GPa.

20. The process of claim 19, wherein the elastomeric material has a tensile strength of less than 80 MPa.

* * * * *